137-13 SR

12/18/79 OR 4,178,951

United States Patent [19]

Sweeney

[11] 4,178,951

[45] Dec. 18, 1979

[54] LOW POUR POINT CRUDE OIL COMPOSITIONS

[75] Inventor: William M. Sweeney, Wappingers Falls, N.Y.

[73] Assignee: Texaco Inc., White Plains, N.Y.

[21] Appl. No.: 950,197

[22] Filed: Oct. 10, 1978

[51] Int. Cl.[2] ..... F17D 1/17

[52] U.S. Cl. ..... 137/13; 44/62; 44/70

[58] Field of Search ..... 44/62, 70; 137/13; 260/878; 526/331

[56] References Cited

U.S. PATENT DOCUMENTS

| | | | |
|---|---|---|---|
| 3,048,479 | 8/1962 | Ilnyckyj et al. | 44/62 |
| 3,462,249 | 8/1969 | Tunkel | 44/62 |
| 3,467,597 | 9/1969 | Tunkel et al. | 44/62 |
| 3,675,671 | 7/1972 | Sweeney | 137/13 |
| 3,870,063 | 3/1975 | Hayward | 137/13 |
| 4,127,140 | 11/1978 | Sweeney | 137/13 |

*Primary Examiner*—Winston A. Douglas
*Assistant Examiner*—Y. Harris-Smith
*Attorney, Agent, or Firm*—Carl G. Ries; Robert A. Kulason; Walter D. Hunter

[57] ABSTRACT

A crude oil composition having a low pour point is prepared by incorporating into a waxy crude oil an effective pour depressant amount of an oil-soluble polymer, such as vinyl acetate-ethylene-propylene or butylene terpolymer or a graft copolymer in which propylene or butylene is grafted onto an ethylene-vinyl acetate copolymer backbone or basic chain. The terpolymer may be added with mixing directly to the heated crude or in hydrocarbon solution such as a solution of the terpolymer in a middle distillate or kerosene. In another aspect, this invention relates to a process for the pipeline transportation of the crude oil compositions previously described.

9 Claims, No Drawings

LOW POUR POINT CRUDE OIL COMPOSITIONS

BACKGROUND OF THE INVENTION

1. Field of the Invention

This invention is concerned with means for providing crude oil compositions having low pour points containing a waxy crude and an effective pour depressant amount of an oil-soluble terpolymer or a graft type polymer.

2. Description of the Prior Art

Certain waxy crude oils, such as the high-pour crude oils, exhibit poor flow properties. A number of processes have been suggested in the art for dealing with such flow problems. For example, the pour point of waxy crudes has been improved by the removal of a part of the wax by solvent extraction at low temperatures, with the attendant expense of recovering the solvent, and the problem of disposing of the wax and of providing the cooling requirements which are substantial. In more recently proposed processes, wax has been removed without the use of a solvent by centrifuging a previously heated crude which has been cooled at a critically controlled and slow rate to a centrifuging temperature of around 35°-55° F.

Another widely practiced process involves cutting the waxy high-pour crudes with lighter fractions of hydrocarbons. This process suffers from a number of disadvantages, such as the fact that the procedure involves the use of relatively large amounts of expensive hydrocarbon solvents to transport a relatively cheap product. Furthermore, this practice also necessarily requires that the cutting hydrocarbon solvents be available in suitable quantities which in some instances is inconvenient, and also that there be a ready market for the solvents at the other end of the pipeline.

In transporting waxy crudes with high pour points by one method, heating equipment along the pipeline at frequent intervals is utilized to heat the crude and thus reduce its viscosity. Heaters employed for this purpose can be operated by withdrawing from the crudes being transported for use as fuels. As much as 5 percent of the crude may be utilized in providing the heating necessary for reducing the crude oil viscosity to a suitable value. Furthermore, most pipelines are not equipped with such heating installations. Also, there is the additional problem of contamination of the atmosphere when burning crude oils they may be difficult to burn completely.

A principal object of this invention is to provide a crude oil composition which possesses an improved pour point and flow properties.

BRIEF DESCRIPTION OF THE INVENTION

In its broadest aspect this invention relates to crude oil compositions having low pour points comprising a waxy crude oil containing an effective pour depressant amount of an oil-soluble terpolymer or a graft polymer. The terpolymer used in preparing the crude oil compositions of this invention is a vinyl acetate-ethylene-propylene or butylene terpolymer. While the graft copolymer comprises an ethylene-vinyl acetate copolymer backbone or basic chain having grafted thereto propylene or butylene. In another aspect this invention relates to a process for the pipeline transportation of the above-described crude oil compositions.

DETAILED DESCRIPTION OF THE INVENTION

Although the crude oil compositions of this invention may be prepared using any crude oil, the terpolymer or graft polymer pour depressant previously described is particularly effective with high pour, waxy crude oils.

Waxy crude oil useful in preparing the novel crude oil compositions of this invention include, for example, the high-pour, high-wax, low-sulfur crude oils having an API gravity of about 30 to about 40; a sulfur content of between about 0.10 and about 2.0 percent by weight; a Saybolt viscosity of 100° F. of about 20 to about 100 SUS; a wax content of between about 3 and 20 percent by weight; and a pour point between about 40° and about 100° F. A waxy, high-pour, low-sulfur crude oil which has been given particularly good results in the low-pour point oil compositions of this invention is known as "Amna" crude and has an API gravity of about 36.0; a Saybolt viscosity of about 69.8 SUS at 100° F.; a pour point of about +70° F.; a wax content of about 14.0 weight percent; and a sulfur content of about 0.15 weight percent. Mixtures of the high-pour, low-sulfur, waxy crude oils may be utilized in preparing the crude oil compositions of this invention, if desired.

One type of oil-soluble polymer useful in preparing the crude oil compositions of this invention is a terpolymer of vinyl acetate, ethylene and propylene or butylene.

The number average molecular weight of the vinyl acetate-ethylene-propylene or butylene terpolymer utilized in this invention as previously described will range from about 5000 to about 80,000 or more and preferably will be from about 12,000 to about 60,000 as determined by vapor pressure osmometry.

In the vinyl acetate-ethylene-propylene or butylene terpolymer the weight percent of the vinyl acetate units is about 10 to about 45; the weight percent of propylene or butylene units is about 0.01 to about 5.0 with the ethylene units being the balance.

Preparation of the vinyl acetate-ethylene-propylene or butylene terpolymer is conducted using processes well known in the art. For example, ethylene, vinyl acetate, and propylene in benzene are reacted in a stirred autoclave at a temperature of about 130° to about 150° C. and under pressures ranging from about 700 to 2000 psig. A variety of catalysts may be utilized however, a preferred catalyst is di-tert. butyl peroxide which is added in benzene at the rate of about 0.5 to 2.0 lbs./1000 lbs. of polymer. Residence time in the reactor is about 0.1 to about 1.0 hours or more. After the reaction mixture is removed from the reactor, the solvent and unreacted starting materials are stripped off yielding the terpolymer product.

In the graft copolymers utilized in this invention, propylene or butylene is grafted onto a backbone or basic chain which is a copolymer of ethylene and vinyl acetate. The weight percent of propylene or butylene ranges is from about 0.6 to about 5.0 and the weight percent of vinyl acetate is about 17 to about 40 with the balance being ethylene. The number average molecular weights of these graft copolymers will range from about 4000 to about 80,000 or more.

The ethylene-vinyl acetate copolymers utilized in preparing the graft copolymers may be prepared by any convenient process, such as that of U.S. Pat. Nos. 3,048,479 and 3,215,678, by a free radical-initiated polymerization of ethylene and a vinyl acetate. An especially useful group of ethylene-vinyl acetate copolymers are those manufactured by E. I. duPont de Nemours and sold under the tradename "Elvax" . The characteristics of the various Elvax additives are given in Table I below:

TABLE I

| "ELVAX" | % Vinyl Acetate in Copolymer | Melt Index* |
|---|---|---|
| 40 | 39–42 | 45–70 |
| 150 | 32–34 | 22–28 |
| 210 | 27–29 | 335–465 |
| 220 | 27–29 | 125–175 |
| 240 | 27–29 | 22–28 |
| 250 | 27–29 | 12–18 |
| 260 | 27–29 | 5–7 |
| 310 | 24–26 | 335–465 |
| 350 | 24–26 | 16–22 |
| 360 | 24–26 | 1.6–2.4 |
| 410 | 17–19 | 430–580 |
| 460 | 17–19 | 2.1–2.9 |

*in g/10 min. as determined by ASTM 1328 modified.

In preparing the ethylene-vinyl acetate copolymers generally the polymerization is conducted at temperatures of about 280° to about 340° F. and at pressures ranging from about 700 to about 2000 psig and, preferably, at about 750 to about 950 psig. The autoclave employed containing the solvent such as benzene, toluene, etc. and the vinyl acetate is first purged about three times with nitrogen, twice with ethylene and then charged with sufficient ethylene to give the desired pressure when heated to the reaction temperature. Additional ethylene is added as the polymerization procedes whenever it is needed. Generally the polymerization is considered to be complete when the pressure of the autoclave drops to less than about 60 psig. The viscous copolymer is recovered by stripping off the solvent and any unreacted vinyl acetate which remains under vacuum.

Graft copolymers where the graft is propylene or butylene and the basic chain is a copolymer of ethylene and vinyl acetate, can be made, for example, by redissolving an ethylene-vinyl acetate copolymer in benzene or other suitable hydrocarbon solvent, placing the copolymer solution in a stirred autoclave with the requisite amount of propylene or butylene together with a peroxide type catalyst and causing the grafting under the influence of heat and pressure. Temperatures of from about 250° to about 400° F. may be employed at autogenous pressure.

The amount of terpolymer or graft copolymer pour depressant incorporated into the crude oil compositions of this invention may be varied over a wide range. Generally the amount of the terpolymer in the crude oil composition will vary from about 0.01 to about 0.50 weight percent and preferably between about 0.02 to about 0.25 weight percent.

The required amount of vinyl acetate-ethylene-propylene or butylene terpolymer or the graft copolymer may be added with mixing directly to the crude oil which preferably is heated. Preferably, the terpolymer or graft copolymer is added to the crude oil in solution form dissolved in a hydrocarbon such as toluene, kerosene, etc., at a temperature of about 30 to about 150° C. with mixing.

The following example illustrates one embodiment of this invention and is to be considered not limitative.

EXAMPLE I

A terpolymer is prepared by introducing 10 parts of ethylene, 4.3 parts vinyl acetate, 0.1 parts of propylene and 3 parts of benzene per hour into a stirred 2-liter autoclave maintained at a temperature of 140°–150° C. at 1450 psig. Di-tert. butyl peroxide is employed as the catalyst and is introduced in benzene into the reactor at the rate of 0.8 lbs./1000 lb. of polymer. The product is continuously removed from the reactor giving a residence time of 15 minutes. After the reaction mixture is removed from the reactor, it is stripped of solvent and unreacted materials yielding the terpolymer product. The composition of the terpolymer is about 26 weight percent vinyl acetate, 0.6 weight percent of propylene with the balance being ethylene. The number average molecular weight of the terpolymer as measured by vapor pressure osmometry is about 21,500.

A crude oil composition is prepared by adding with mixing at 150° F. for one hour a sufficient amount of the above prepared terpolymer to Amna crude so that the concentration of the additive was 0.14 weight percent. The pour point of this composition is determined by the method of ASTM D-97 and found to be substantially below that of the Amna crude alone which exhibits a pour point of 80° F.

In another aspect, this invention relates to an improved proces for the transportation of the novel crude oil compositions described in detail above.

The improved process of this invention for the pipeline transportation of the crude oil composition described above comprises introducing into the said pipeline a crude oil composition comprising a waxy, crude oil and an effective pour depressant amount of the vinyl acetate-ethylene-propylene or butylene terpolymer or the graft type copolymer previously described. Generally, the amount of the terpolymer or graft copolymer will range from about 0.01 to about 0.50 weight percent.

What is claimed is:

1. A crude oil composition having improved pour point characteristics comprising a waxy crude oil and an effective pour depressant amount of an oil-soluble polymer selected from the group consisting of (A) a terpolymer of vinyl acetate, ethylene and an olefin selected from the group consisting of propylene and butylene and (B) a graft copolymer comprising an ethylene-vinyl acetate copolymer backbone having grafted thereto an olefin selected from the group consisting of propylene and butylene.

2. The composition of claim 1 wherein the said oil-soluble polymer is a graft copolymer, wherein the number average molecular weight of the said copolymer is from about 4000 to about 60,000; wherein the weight percent of vinyl acetate in the said graft copolymer is about 17 to about 40; the weight percent of propylene or butylene is about 0.6 to about 5.0 with the balance being ethylene.

3. The composition of claim 1 wherein the said oil-soluble polymer is a terpolymer which comprises about 15 to about 45 weight percent vinyl acetate, from about 0.1 to about 5.0 weight percent propylene or butylene with the balance being ethylene.

4. The composition of claim 1 wherein the said oil-soluble polymer is a terpolymer which comprises about 26 percent by weight vinyl acetate, about 0.6 percent by weight of propylene with the balance being ethylene.

5. The composition of claim 3 wherein the number average molecular weight of the said terpolymer will range from about 5000 to about 80,000.

6. The composition of claim 3 wherein the number average molecular weight of the said terpolymer will range from about 12,000 to about 60,000.

7. In the transportation of crude oils, the improvement which comprises introducing into a pipeline the crude oil composition comprising a waxy crude oil and an effective pour depressant amount of an oil-soluble polymer selected from the group consisting of (A) a terpolymer comprising of vinyl acetate, ethylene and an olefin selected from the group consisting of propylene and butylene and a graft copolymer comprising an ethylene-vinyl acetate copolymer backbone having grafted thereto an olefin selected from the group consisting of propylene and butylene.

8. The process of claim 7 wherein the said oil soluble polymer is a terpolymer which comprises about 15 to about 28 weight percent vinyl acetate, from about 0.1 to about 5.0 weight percent propylene or butylene with the balance being ethylene.

9. The process of claim 7 wherein the said oil soluble polymer is a terpolymer which comprises about 26 percent by weight vinyl acetate, about 0.6 percent by weight of propylene with the balance being ethylene.

* * * * *